US007293967B2

(12) United States Patent
Fukano et al.

(10) Patent No.: US 7,293,967 B2
(45) Date of Patent: Nov. 13, 2007

(54) PUMP APPARATUS

(75) Inventors: Yoshihiro Fukano, Moriya (JP); Takamitsu Suzuki, Mitsukaido (JP)

(73) Assignee: SMC Kabushiki Kaisha, Tokyo (JP)

( * ) Notice: Subject to any disclaimer, the term of this patent is extended or adjusted under 35 U.S.C. 154(b) by 719 days.

(21) Appl. No.: 10/681,235

(22) Filed: Oct. 9, 2003

(65) Prior Publication Data

US 2004/0076526 A1 Apr. 22, 2004

(30) Foreign Application Priority Data

Oct. 22, 2002 (JP) ..... 2002-307219

(51) Int. Cl.
*F04B 17/03* (2006.01)
*F04B 9/04* (2006.01)

(52) U.S. Cl. ..... 417/413.1; 92/98 D; 92/136

(58) Field of Classification Search ..... 417/44.2–44.9, 417/413.1; 92/98 D, 136
See application file for complete search history.

(56) References Cited

U.S. PATENT DOCUMENTS

| | | | | |
|---|---|---|---|---|
| 1,085,818 | A * | 2/1914 | Oxnard | 92/98 D |
| 1,580,131 | A * | 4/1926 | Ghiardi | 92/136 |
| 2,807,213 | A * | 9/1957 | Rosen | 92/5 R |
| 3,204,858 | A | 9/1965 | Dros | |
| 3,250,225 | A * | 5/1966 | Taplin | 417/413.1 |
| 4,182,599 | A * | 1/1980 | Eyrick et al. | 92/98 D |
| 4,569,378 | A * | 2/1986 | Bergandy | 92/98 D |
| 4,639,245 | A * | 1/1987 | Pastrone et al. | 417/413.1 |
| 5,415,528 | A * | 5/1995 | Ogden et al. | 417/44.8 |
| 5,577,433 | A * | 11/1996 | Henry | 92/136 |
| 6,068,198 | A * | 5/2000 | Gupta | 92/98 D |
| 6,079,959 | A * | 6/2000 | Kingsford et al. | 92/98 D |

FOREIGN PATENT DOCUMENTS

| | | |
|---|---|---|
| AT | 243423 | 11/1965 |
| DE | 195 23 370 | 1/1997 |
| EP | 0 835 428 | 4/1998 |
| FR | 2 697 589 | 5/1994 |
| JP | 55-167589 | 12/1980 |
| JP | 63-253182 | 10/1988 |
| JP | 7-16044 | 3/1995 |
| JP | 9-53566 | 2/1997 |
| JP | 10-47234 | 2/1998 |

* cited by examiner

*Primary Examiner*—Michael Koczo, Jr.
(74) *Attorney, Agent, or Firm*—Paul A. Guss

(57) ABSTRACT

A constant rate discharge pump comprises a rotary shaft which is rotatable together with a rotary driving source, a piston which is displaceable in an axial direction in a pump chamber of a body by the rotation of the rotary shaft and which has a tapered surface having diameters reduced downwardly on an outer circumference thereof, and a skirt section which is disposed on the piston and which extends radially outwardly. The constant rate discharge pump further includes a valve plug membrane of a resin material which is displaceable together with the piston, and a pressure sensor installed in the body which detects a pressure of a fluid flowing through the pump chamber.

13 Claims, 6 Drawing Sheets

PUMP APPARATUS

BACKGROUND OF THE INVENTION

1. Field of the Invention

The present invention relates to a pump apparatus which makes it possible to discharge a constant amount of a fluid all the time by controlling the flow rate of the fluid by rotation of a driving source.

2. Description of the Related Art

A constant rate discharge pump has been adopted in order to supply a constant amount of a chemical solution, a paint, a washing solution, or the like, for an apparatus of producing semiconductors or the like, a painting apparatus, and a medical apparatus.

A bellows type pump is often used for the constant rate discharge pump. In the bellows type pump, the suction pressure and the discharge pressure are obtained by expanding/contracting bellows surrounding a shaft member, driven by a motor or the like.

In this apparatus, the shaft member is displaced in the axial direction by the driving source such as the motor. The tip section of the shaft member is displaced in a pump chamber which is formed in a pump housing. The bellows is interposed between the tip section and the pump chamber, and the bellows is expanded/contracted when the tip section is displaced. The suction pressure is generated when the bellows is contracted in the pump chamber. Accordingly, liquid is sucked from the outside, and the pump chamber is filled with the liquid. On the other hand, the discharge pressure is generated by expanding the bellows in the pump chamber. Accordingly, the liquid is discharged from the pump chamber to the outside (see, for example, Japanese Laid-Open Patent Publication No. 10-47234).

In the case of the conventional constant rate discharge pump, when the flow rate of the fluid to be sucked and discharged is increased, it is necessary to set a large stroke of the shaft member and the tip section in the axial direction in response to the flow rate. In such a situation, the bellows needs to be large, which is expanded/contracted in conformity with the increase of the stroke amount. However the production cost becomes expensive, because the bellows is expensive.

When the flow rate of the fluid to be sucked and discharged is increased, the amounts of expansion and contraction of the bellows are increased. As a result, some pulsation may occur in the fluid when the fluid is discharged from the pump chamber to the outside.

Further, when a liquid is sucked into the pump chamber, the liquid remaining in the pump chamber after discharging the liquid from the pump chamber to the outside may be pooled on the outer circumferential surface of the bellows.

SUMMARY OF THE INVENTION

A general object of the present invention is to provide a pump apparatus which makes it possible to reduce the cost and which makes it possible to discharge a constant amount of a fluid highly accurately without causing any pulsation of the fluid even when the large amount of fluid flows in the pump.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
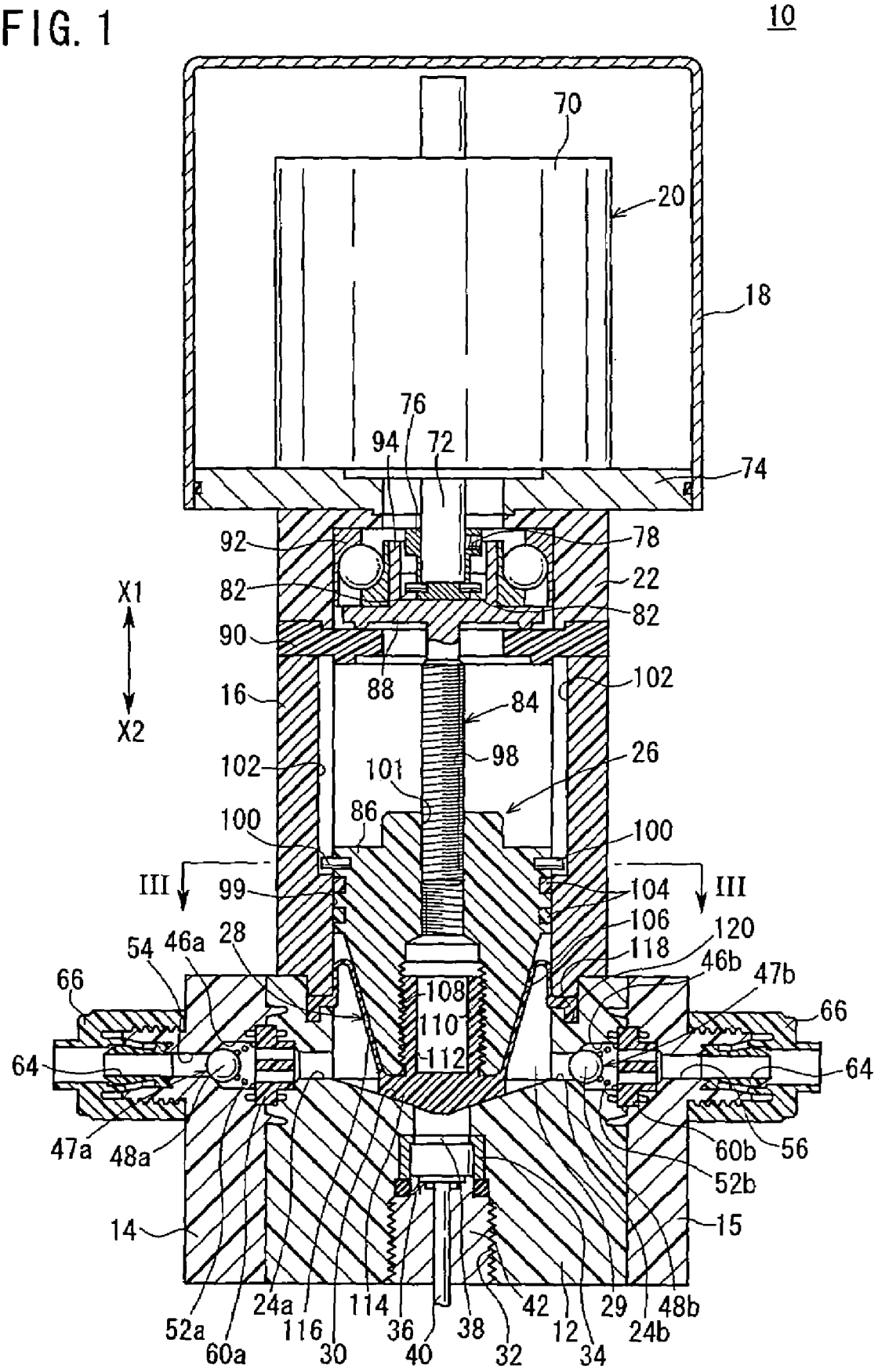
FIG. 1 is a vertical sectional view taken in the axial direction illustrating a constant rate discharge pump according to an embodiment of the present invention.

With reference to FIG. 1, reference numeral 10 indicates a constant rate discharge pump according to an embodiment of the present invention.

The constant rate discharge pump 10 comprises a body 12 in which fluid passages 24*a*, 24*b* for flowing the fluid are formed, first and second joint members 14, 15 which are connected to side portions of the body 12 and to which unillustrated tubes are detachably connected, a bonnet 16 which is connected to an upper portion of the body 12, and a driving section 20 which is provided in a cover member 18 arranged on the bonnet 16 and which is driven and rotated by an electric signal supplied from an unillustrated power source. The constant rate discharge pump 10 further comprises a holding member 22 which is interposed between the bonnet 16 and the driving section 20 for holding a bearing 92 as described later on, and a flow rate control mechanism 26 which controls the flow rate of the fluid flowing through the fluid passages 24*a*, 24*b* by the driving section 20.

A pump chamber 29 is provided at a substantially central portion of the body 12 under the lower surface of a valve plug membrane 28 of a resin material which is formed flexibly or bendably. A seat section 30 is formed at a lower portion of the pump chamber 29, on which the valve plug membrane 28 is seated. The seat section 30 has a tapered shape with diameters decreased gradually downwardly.

A through-hole 32 is formed in the axial direction in the body 12, and communicates with the pump chamber 29 via the seat section 30. A pressure sensor 36 is installed into the through-hole 32 by an adapter 34.

A detecting section 38 is provided at an upper portion of the pressure sensor 36 to detect the pressure of the fluid flowing into the pump chamber 29. The pressure sensor 36 is connected to an unillustrated controller via a lead wire 40. The pressure value detected by the detecting section 38 is outputted as an output signal to the controller.

A plug 42 is screwed with and closes the through-hole 32 upwardly while the pressure sensor 36 is installed to the through-hole 32. The lead wire 40 of the pressure sensor 36 is guided to the outside via a hole formed through a substantially central portion of the plug 42.

On the other hand, the fluid passages 24*a*, 24*b* are formed through the side portions of the body 12. The fluid passage 24*a* communicates with the pump chamber 29 of the body 12 and first port 54 of the first joint member 14. The fluid passage 24*b* communicates with the pump chamber 29 of the body 12 and second port 56 of the second joint member 15. That is, the fluid passage 24*a* is formed near the first joint member 14, and the fluid passage 24*b* is formed near the second joint member 15.

A large diameter section 46*b* is formed in the fluid passage 24*b* near the second joint member 15. The large diameter section 46*b* has expanded diameters radially outwardly as compared with the inner diameter of the second port 56. A spherical valve plug 48*b* is arranged in the large diameter section 46*b*, which functions as a second check valve 47*b*. The valve plug 48*b* has a diameter which is slightly larger than the inner diameter of the fluid passage 24*b*. A valve seat section 50*b* is formed on the large diameter section 46*b*. The valve seat section 50*b* has a tapered shape (see FIG. 2) with its diameters gradually reduced toward the fluid passage 24*b*.

A spring (second spring) 52*b* is interposed between the valve plug 48*b* and a connecting member 60*b* installed to the second joint member 15 (as described later on). The spring 52*b* urges the valve plug 48*b* in the direction in which the valve plug 48*b* is pressed against the valve seat section 50*b*. That is, the valve plug 48*b* is seated on the valve seat section 50*b* by being pressed under the action of the spring force of the spring 52*b*. Accordingly, the communication between the fluid passage 24*b* and the large diameter section 46*b* is shut off by the valve plug 48*b*.

The first joint member 14 and the second joint member 15 are connected to the side portions of the body 12, so that the first joint member 14, the second joint member 15, and the body 12 are aligned. The fluid is sucked through the first joint member 14 from the outside via the unillustrated tube, and the fluid is discharged through the second joint member 15 to the outside via the tube.

The first port 54 is formed in the first joint member 14, and the second port 56 is formed in the second joint member 15. The first and second ports 54, 56 communicate with the fluid passages 24*a*, 24*b* of the body 12, respectively, via the connecting members 60*a*, 60*b*.

The connecting members 60*a*, 60*b* are arranged in installation holes disposed at the ends of the first and second ports 54, 56 near the body 12, respectively. The connecting members 60*a*, 60*b* are interposed between the body 12 and the first and second joint members 14, 15, respectively.

Communication passages 62*a*, 62*b* are formed penetratingly at substantially central portions of the connecting members 60*a*, 60*b*. The first and second ports 54, 56 communicate with the fluid passages 24*a*, 24*b* via the communication passages 62*a*, 62*b*, respectively.

Inner members 64 are engaged with the first port 54 of the first joint member 14 and the second port 56 of the second joint member 15, respectively. Lock nuts 66 are screwed with the ends of the first and second joint members 14, 15 while the openings of the unillustrated tubes are inserted into the inner members 64. Accordingly, the liquid tightness is retained at the connecting portions of the tubes when the lock nuts 66 are screwed.

On the other hand, a large diameter section 46*a* is formed near the body 12 in the first port 54. The large diameter section 46*a* is diametrically expanded radially outwardly as compared with the inner diameter of the first port 54. A spherical valve plug 48*a* is arranged in the large diameter section 46*a* and functions as a first check valve 47*a*. The valve plug 48*a* has a diameter which is slightly larger than the inner diameter of the first port 54.

A valve seat section 50*a* is formed at the end of the large diameter section 46*a*. The valve seat section 50*a* has a tapered shape with its diameters gradually reduced toward the first port 54.

A spring (first spring) 52*a* is interposed between the valve plug 48*a* and a connecting member 60*a*. The spring 52*a* urges the valve plug 48*a* in the direction in which the valve plug 48*a* is pressed against the valve seat section 50*a*. That is, the valve plug 48*a* is seated on the valve seat section 50*a* while pressed by the spring force of the spring 52*a*. Accordingly, the communication between the first port 54 and the large diameter section 46*a* is shut off by the valve plug 48*a*.

The driving section 20 includes a rotary driving source 70 which is rotatable in accordance with an electric signal supplied from an unillustrated power source, and a drive shaft 72 which transmits the rotary driving force of the rotary driving source 70.

The rotary driving source 70 is, for example, a step motor. The rotary driving source 70 is arranged on the upper surface of a plate member 74 in the cover member 18. The drive shaft 72 penetrates through the plate member 74 and protrudes from the lower surface of the rotary driving source 70. The drive shaft 72 is rotated together with the rotation of the rotary driving source 70.

A connecting member 76 having a substantially C-shaped cross section is inserted upwardly into the lower end of the drive shaft 72. The connecting member 76 is integrally installed to the drive shaft 72 by a screw member 78 which is screwed in the direction substantially perpendicular to the axis of the drive shaft 72 from the outer circumferential surface thereof.

Engaging pins 82 are installed to a plurality of grooves formed on the outer circumferential surface of the connecting member 76 so that the engaging pins 82 protrude radially outwardly. The engaging pins 82 are provided at two positions so that the engaging pins 82 are spaced from each other by a predetermined angle in the circumferential direction of the connecting member 76.

The flow rate control mechanism 26 includes a rotary shaft 84 which is rotatable together with the rotation of the rotary driving source 70, a piston 86 which is displaceable in the axial direction in the bonnet 16 by the rotation of the rotary shaft 84, and the valve plug membrane 28 which is integrally connected to the piston 86.

The rotary shaft 84 is elongate, and is arranged under the connecting member 76.

A disk-shaped flange section 88 diametrically expanded outwardly is formed at an upper portion of the rotary shaft 84. The flange section 88 is interposed between the bearing 92 and a spacer 90. The spacer 90 is interposed between the holding member 22 and the bonnet 16. Accordingly, the displacement of the rotary shaft 84 in the axial direction is restricted.

An annular projection 94 protruding upwardly by a predetermined length is formed on the upper surface of the flange section 88. The outer circumferential surface of the projection 94 is rotatably supported by the bearing 92. Grooves are formed at positions opposed to the engaging pins 82 of the connecting member 76 on the inner circumferential side of the projection 94. Each of the grooves is recessed by a predetermined length. The engaging pins 82 are engaged with the grooves.

That is, the engaging pins 82, which are engaged with the connecting member 76, are engaged with the grooves of the rotary shaft 84. Thus, the rotary shaft 84 is rotated together with the rotation of the rotary driving source 70 via the connecting member 76.

On the other hand, a screw section 98 is formed at a lower portion of the rotary shaft 84, on which a screw is engraved on the outer circumferential surface. The screw section 98 is screwed with a screw hole 101 of the piston 86 which is provided displaceably in the axial direction in the bonnet 16.

The piston 86 of the resin material is displaced in the axial direction by the rotation of the rotary shaft 84, and the outer circumferential surface of the piston 86 slides along the inner wall surface 99 of the bonnet 16.

A pair of rotation-preventive pins 100 are installed to grooves formed on the outer circumferential surface of the piston 86, and protrude radially outwardly by predetermined lengths. The rotation-preventive pins 100 are engaged with a pair of engaging grooves 102 which are formed and recessed by predetermined lengths on the inner wall surface 99 of the bonnet 16 (see FIG. 3). Each of the engaging grooves 102 is substantially linear in the axial direction. That is, when the piston 86 is displaced in the axial direction by the rotary driving source 70, the rotation-preventive pins 100 are engaged with the engaging grooves 102. Therefore, the rotation of the piston 86 in the circumferential direction is prevented.

Figure 4:
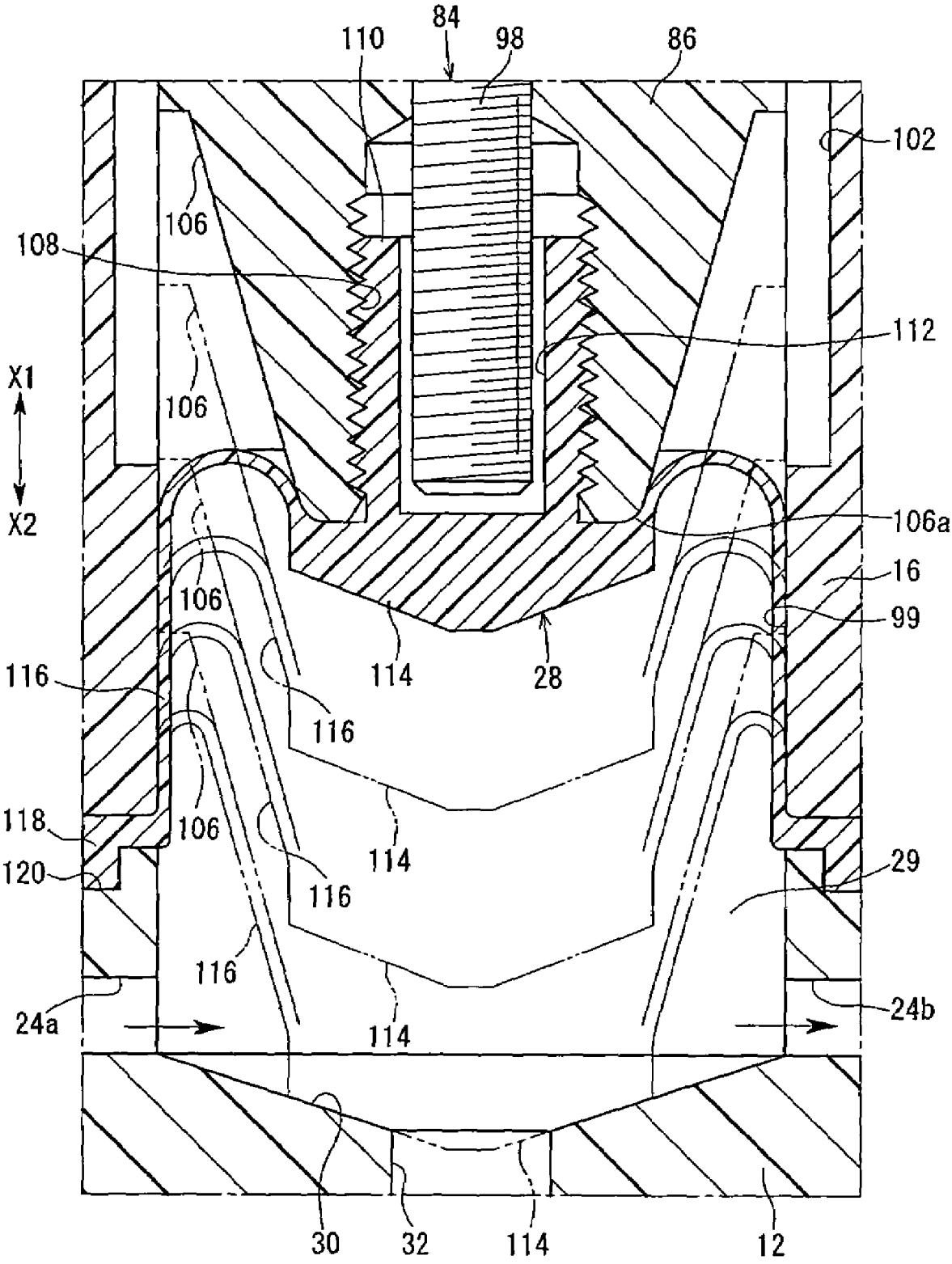
FIG. 4 is, with partial omission, a magnified vertical sectional view taken in the axial direction illustrating the displacement in the axial direction of a valve plug membrane of the constant rate discharge pump shown in FIG. 1.

Wear rings 104 are installed to annular grooves formed on the outer circumferential surface of the piston 86. Further, a tapered surface 106 (see FIG. 4) is formed on the outer circumferential surface of the piston 86, which is inclined by a predetermined angle so that the diameters are gradually reduced downwardly from the portions of the outer circumferential surface of the piston 86 at which the wear rings 104 are installed. A chamfered section 106*a* as shown in FIG. 4 is formed at the lower end of the tapered surface 106.

A screw hole 108 is formed in the axial direction in the piston 86. A shaft section 110 of the valve plug membrane 28 of the resin material is integrally screwed with the screw hole 108 as described later on. That is, the valve plug membrane 28 is displaced together with the displacement of the piston 86 in the axial direction. A hole 112, which is open upwardly, is formed in the shaft section 110 of the valve plug membrane 28. When the valve plug membrane 28 is displaced upwardly, the screw section 98 of the rotary shaft 84 is inserted thereinto. Therefore, the hole 112 has a diameter which is slightly larger than the diameter of the screw section 98 of the rotary shaft 84.

The valve plug membrane 28 is formed of the resin material such as PTFE (polytetrafluoroethylene), which is a fluororesin. The valve plug membrane 28 includes the shaft section 110 which is screwed into the piston 86, a thick-walled main valve body section 114 which is formed under the shaft section 110 and which is diametrically expanded outwardly as compared with the shaft section 110, and a skirt section 116 which extends radially outwardly from the upper surface of the main valve body section 114. A circumferential edge 118 of the skirt section 116 of the valve plug membrane 28 is fitted into and supported in an annular recess 120 which is formed by the body 12 and the bonnet 16.

The skirt section 116 is connected to the upper circumferential edge of the main valve body section 114, which is formed to rise or stands in conformity with or along the tapered surface 106 of the piston 86. On the other hand, the skirt section 116 is connected to the upper portion of the circumferential edge 118 to rise or stands in conformity with or along the inner wall surface 99 of the bonnet 16 (see FIGS. 1 and 2).

The lower surface of the main valve body section 114 has a tapered shape with diameters gradually reduced downwardly corresponding to the seat section 30 of the body 12. When the piston 86 is displaced to the lower end, the lower surface of the main valve body section 114 abuts against the seat section 30 of the body 12 tightly.

The skirt section 116 is formed as a bendable thin-walled membrane. When the piston 86 is displaced downwardly, the skirt section 116 is gradually disposed on or engaged with the tapered surface 106 of the piston 86 from the vicinity of the main valve body section 114 radially outwardly. Also, the portion of the skirt section 116 in the vicinity of the circumferential edge 118 is bent or curved to be convex upwardly between the main valve body section 114 and the inner wall surface 99 of the bonnet 16 (see FIGS. 1 and 4).

Figure 2:
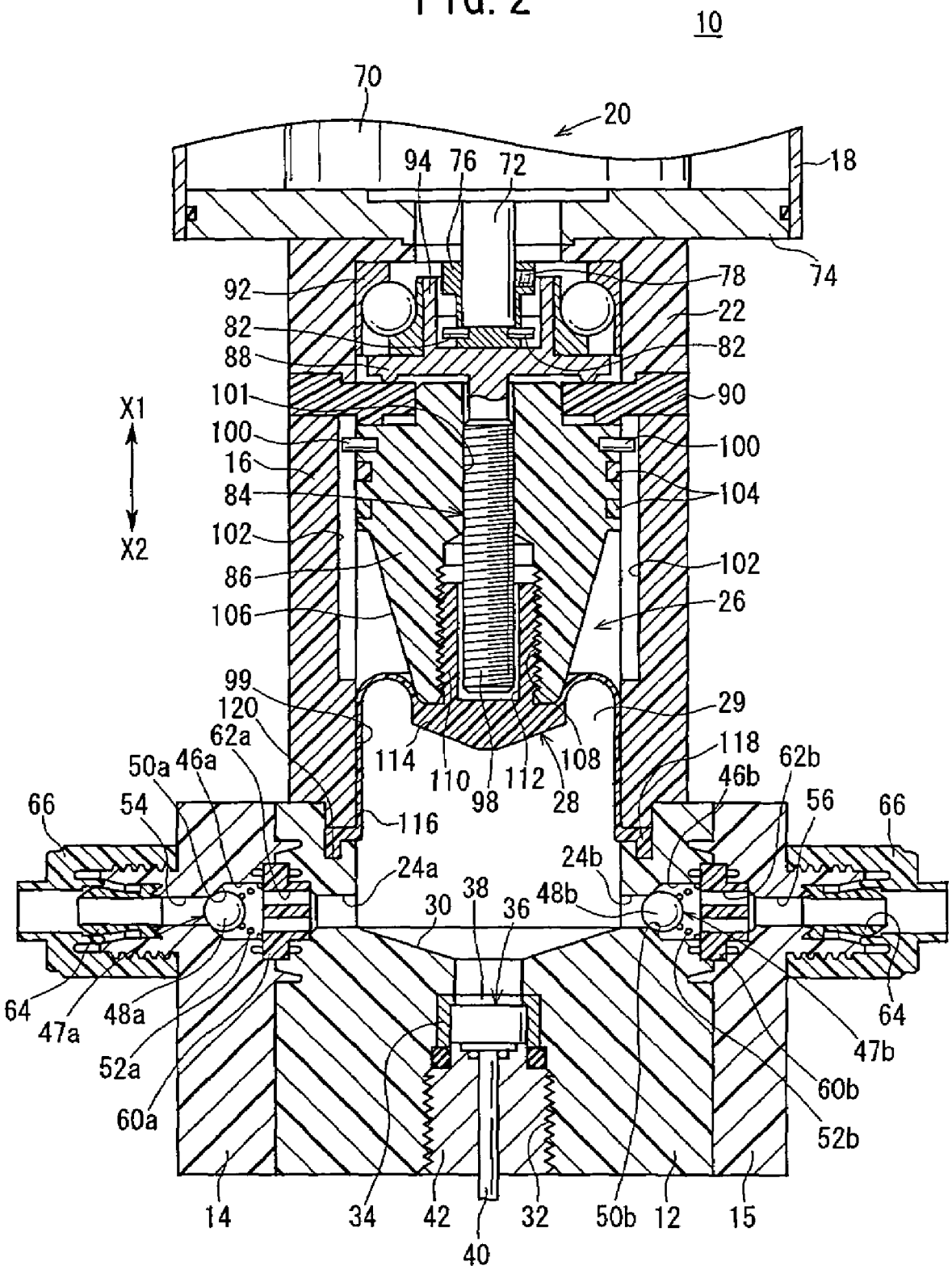
FIG. 2 is a vertical sectional view taken in the axial direction illustrating a state in which a piston is displaced in the direction of the arrow X1 starting from a state shown in FIG. 1.

On the other hand, when the piston 86 is displaced upwardly, the skirt section 116 is gradually disposed on or engaged with the inner wall surface 99 of the bonnet 16 radially inwardly from the vicinity of the circumferential edge 118, and the portion of the skirt section 116 in the vicinity of the main valve body section 114 is bent or curved to be convex upwardly between the main valve body section 114 and the inner wall surface 99 of the bonnet 16 (see FIGS. 2 and 4).

As for the valve plug membrane 28, the lower surface of the main valve body section 114 abuts against the seat section 30 of the body 12, when the piston 86 is displaced to the lower end by the rotation of the rotary driving source 70. Accordingly, the communication is shut off between the fluid passage 24*a* near the first port 54 and the fluid passage 24*b* near the second port 56.

The constant rate discharge pump 10 according to the embodiment of the present invention is basically constructed as described above. Next, its operation, function, and effect will be explained. The explanation will be made assuming that the initial state is as shown in FIG. 1, in which the main valve body section 114 of the valve plug membrane 28 connected to the piston 86 contacts the seat section 30 of the body 12.

Firstly, for example, an unillustrated coating liquid supply source for semiconductor is connected to the first port 54 of the first joint member 14 via an unillustrated tube. On the other hand, for example, an unillustrated coating liquid-dripping apparatus is connected to the second port 56 of the second joint member 15 via an unillustrated tube.

Subsequently, a driving signal is outputted from the unillustrated controller to the rotary driving source 70 on the basis of the preset flow rate of the fluid with the controller.

The current is supplied to the rotary driving source 70 from the unillustrated power source, the drive shaft 72 is rotated by the rotation of the rotary driving source 70, and the rotary shaft 84 is rotated together with the drive shaft 72. In this situation, the rotary shaft 84 is not displaced in the axial direction by the rotation, because the flange section 88 of the rotary shaft 84 is interposed between the bearing 92 and the spacer 90.

As shown in FIG. 2, the piston 86 screwed with the screw section 98 is displaced upwardly (in the direction of the arrow X1) under screwing relationships of the piston 86*in* accordance with the rotation of the rotary shaft 84. Accordingly, the interior of the pump chamber 29 closed by the valve plug membrane 28 connected to the piston 86 is in a suction state (negative pressure state).

When the interior of the pump chamber 29 is in the negative pressure state, the valve plug 48*a*, which is installed in the first joint member 14, is separated from the valve seat section 50*a* against the spring force of the spring 52*a*, and the valve plug 48*a* is displaced toward the body 12.

As a result, the first port 54 of the first joint member 14 communicates with the fluid passage 24*a* of the body 12. The fluid (for example, the coating liquid) passes through the tube connected to the unillustrated coating liquid supply source for semiconductor, and the fluid is supplied from the first port 54 into the pump chamber 29 via the communication passage 62*a* of the connecting member 60*a* and the fluid passage 24*a*.

The valve plug 48*a*, which is arranged in the first joint member 14, functions as the first check valve 47*a* such that the valve plug 48*a* is seated on the valve seat section 50*a* in accordance with the spring force of the spring 52*a*.

Accordingly, when the fluid, which has been supplied into the pump chamber 29 of the body 12, is about to cause counterflow toward the first port 54, the fluid is prevented from the counterflow by the valve plug 48*a* seated on the valve seat section 50*a*.

When the piston 86 is displaced to a position which is based on the flow rate of the fluid previously set by the controller, then a stop signal is outputted from the controller to the rotary driving source 70, and the supply of the current is stopped. As the rotary driving source 70 is stopped, the displacement of the piston 86 in the axial direction is stopped. That is, the flow rate of the fluid sucked into the pump chamber 29 is established by the upward displacement amount in the axial direction from the initial position at which the valve plug membrane 29 is seated on the seat section 30.

Figure 3:
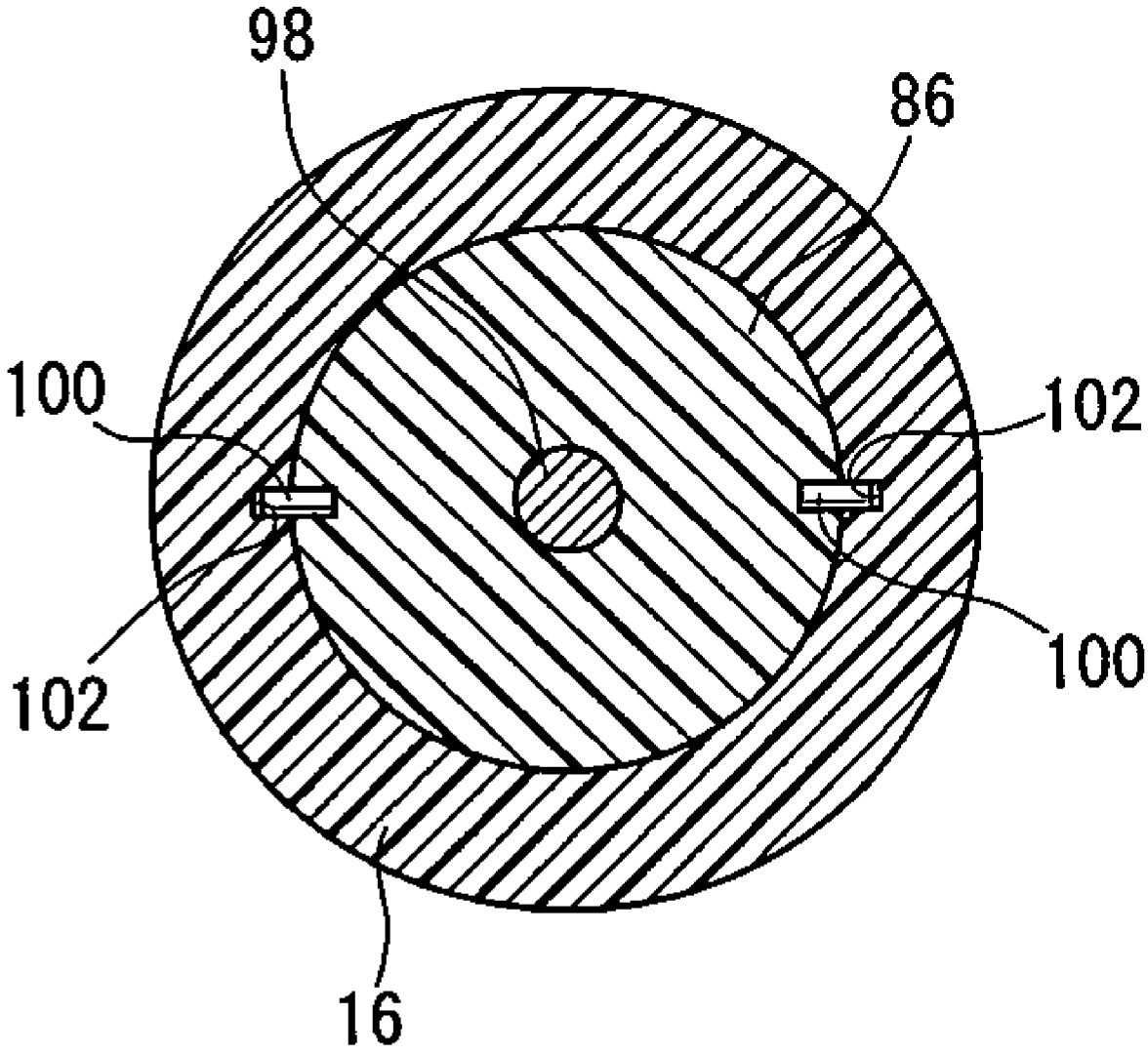
FIG. 3 is a lateral sectional view taken along a line III-III shown in FIG. 1.

When the piston 86 is displaced in the axial direction, the piston 86 is prevented from any rotation, because the rotation-preventive pins 100, which are installed to the outer circumference of the piston 86, are engaged with the engaging grooves 102 (see FIG. 3).

In this situation, the upper surface of the skirt section 116 of the valve plug membrane 28 is disposed on or engaged with the inner wall surface 99 of the bonnet 16 from the circumferential edge 118 which is interposed between the body 12 and the bonnet 16. The portion between the main valve body section 114 and the skirt section 116 engaged with the inner wall surface 99 is retained in a state of being bent or curved upwardly.

That is, when the valve plug membrane 28 is displaced upwardly by the displacement of the piston 86, the skirt section 116 is engaged with or disposed on the inner wall surface 99 of the bonnet integrally. Therefore, when the fluid is supplied into the pump chamber 29 of the body 12, the flow of the fluid is not inhibited or blocked by the skirt section 116 of the valve plug membrane 28 (see FIG. 4).

Next, when the characteristic of the current to be supplied to the rotary driving source 70 is reversed from the above, the rotary driving source 70 is rotated in the opposite direction, and thus the rotary shaft 84 is rotated together with the drive shaft 72 in the opposite direction. The piston 84 is displaced downwardly (in the direction of the arrow X2) in the axial direction under the screwing relationships of the piston 86 with the rotary shaft 84.

When the piston 86 is displaced downwardly, the fluid contained in the pump chamber 29 is pressed by the valve plug membrane 28. The pressed fluid urges the valve plug 48*b* installed in the fluid passage 24*b*, the valve plug 48*b* is thereby separated from the valve seat section 50*b* against the spring force of the spring 52*b*, and the valve plug 48*b* is displaced toward the second joint member 15. Accordingly, the interior of the pump chamber 29 communicates with the second port 56 via the fluid passage 24*b*. The fluid contained in the pump chamber 29 is discharged via the unillustrated tube to the coating liquid-dripping apparatus connected to the second port 56. A constant amount of the fluid (for example, the coating liquid) is dripped onto the semiconductor wafer all the time.

The valve plug 48*b*, which is arranged in the large diameter section 46*b* of the second joint member 15, functions as the second check valve 47*b* such that the valve plug 48*b* is seated on the valve seat section 50*b* by the spring force of the spring 52*b*. Accordingly, when the fluid, which has been discharged to the outside from the second port 56, is about to cause counterflow into the pump chamber 29 again, the fluid is prevented from the counterflow by the valve plug 48*b* seated on the valve seat section 50*b*.

On the other hand, when the fluid flows through the interior of the pump chamber 29, the pressure of the fluid flowing through the interior of the pump chamber 29 is detected by the pressure sensor 36 which is installed to the lower portion of the body 12. The detected pressure is outputted as a detection signal to the unillustrated controller via the lead wire 40 of the pressure sensor 36.

The controller calculates the flow rate A of the fluid flowing through the pump chamber 29 on the basis of the detection signal (pressure value) supplied from the pressure sensor 36. The controller performs the following feedback control. The controller judges the difference (|A−B|) between the calculated flow rate A and the preset flow rate B of the fluid previously set by the controller. The controller outputs a control signal to the rotary driving source 70 so that the difference (|A−B|) becomes zero.

As a result, the preset flow rate B of the fluid corresponds to the amount of rotation of the rotary driving source 70. Therefore, it is possible to flow the fluid at a preset constant flow rate into the pump chamber 29 of the body 12. In other words, it is possible to perform the highly accurate flow rate control of the fluid so that the flow rate of the fluid discharged from the second port 56 is always constant.

For example, when the flow rate A of the fluid discharged from the second port 56 is larger than the preset value B previously set by the unillustrated controller (A>B), then the pressure value of the fluid is detected by the pressure sensor 36, and the detection signal (pressure value) is outputted to the controller. The controller judges the difference (|A−B|) between the preset value previously set by the controller and the flow rate of the fluid. The controller output the control signal to the rotary driving source 70 so that the difference (|A−B|) becomes zero.

Subsequently, the piston 86 is displaced upwardly (in the direction of the arrow X1) by the rotary driving source 70 on the basis of the control signal. The volume of the pump chamber 29 of the body 12 is increased by the valve plug membrane 28. The pressure of the fluid flowing through the interior of the pump chamber 29 is decreased, and the flow rate becomes the preset flow rate B (A=B).

Accordingly, the flow rate of the fluid discharged from the interior of the pump chamber 29 to the second port 56 is decreased, and the preset flow rate is obtained. As a result, it is possible to control the flow rate of the fluid highly accurately so that the flow rate of the fluid discharged from the second port 56 is always constant.

That is, the pressure of the fluid flowing through the interior of the pump chamber 29 is always detected by the pressure sensor 36, and the obtained pressure value is outputted as the detection signal to the unillustrated controller. The controller judges the difference (|A−B|) between the preset flow rate B of the fluid previously set by the controller and the calculated flow rate A. The control signal is outputted to the rotary driving source 70 so that the difference (|A−B|) becomes zero.

When the rotary driving source 70 is rotated on the basis of the control signal, the valve plug membrane 28 is displaced in the axial direction together with the piston 86. As a result, the volume of the pump chamber 29 of the body 12 to be supplied with the fluid is increased/decreased. Therefore, it is possible to control the flow rate of the fluid flowing through the pump chamber 29. Accordingly, the flow rate A of the fluid flowing through the interior of the pump chamber 29 is always controlled to be substantially equivalent to the preset value B. Thus, it is possible to always discharge a constant amount of the fluid from the second port 56.

The tapered surface 106, which has diameters reduced toward the main valve body section 114 of the valve plug membrane 28, is provided on the outer circumferential surface of the piston 86. Therefore, as shown in FIG. 1, when the piston 86 is displaced downwardly (in the direction of the arrow X2), the upper surface of the skirt section 116 is gradually engaged with or disposed on the tapered surface 106 from the side near the main valve body section 114. The portion between the engagement with the tapered surface 106 and the circumferential edge 118 of the skirt section 116 is retained in a bent or curved state. Accordingly, the skirt section 116 of the valve plug membrane 28 of the resin material can be preferably bent along the tapered surface 106 of the piston 86.

As described above, in the embodiment of the present invention, when the piston 86 is displaced downwardly (in the direction of the arrow X2) by the rotary driving source 70, as shown in FIG. 4, the skirt section 116 of the valve plug membrane 28 of the resin material can be preferably bent while effecting the gradual engagement along the tapered surface 106 of the piston 86. Therefore, even when the piston 86 is displaced downwardly, the skirt section 116 of the valve plug membrane 28 does not inhibit the flow of the fluid in the pump chamber 29 of the body 12.

The flow rate of the fluid flowing through the interior of the pump chamber 29 is controlled by integrally providing the valve plug membrane 28 of the resin material disposed at the lower portion of the piston 86 and displacing the valve plug membrane 28 in the axial direction under the driving action of the rotary driving source 70. In this arrangement, the valve plug membrane 28, which is formed of the resin material, has the high rigidity as compared with a diaphragm or the like which is composed of an elastic material. Therefore, the thin skirt section 116 of the valve plug membrane 28 is prevented from being warped.

As a result, it is possible to ensure the large stroke of the piston 86 in the axial direction because the skirt section 116 is prevented from the warpage. It is possible to discharge fluid highly accurately without causing any pulsation of the fluid even when the fluid flows in a large volume through the constant rate discharge pump 10.

Further, it is possible to reduce the production cost as compared with a product having the conventional bellows, because the valve plug membrane 28 is formed of the resin material even when the stroke amount of the piston 86 is set to be large.

Further, even when the fluid flowing through the interior of the pump chamber 29 is a liquid, the liquid does not remain on the lower surface of the valve plug membrane 28 after the liquid is discharged to the outside from the pump chamber 29. Accordingly, any liquid pool on the lower surface of the valve plug membrane 28 can be avoided.

Figure 5:
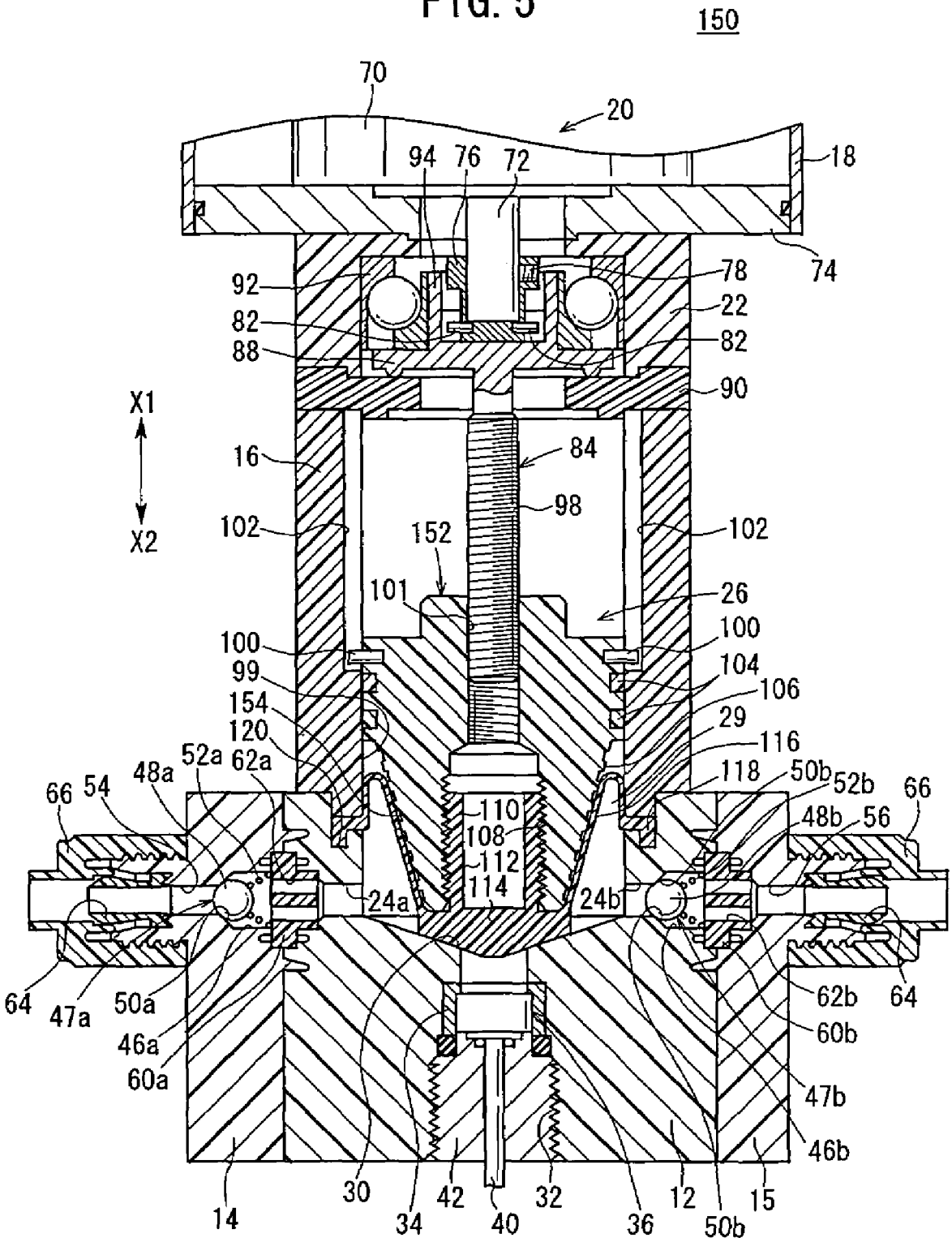
FIG. 5 is, with partial omission, a vertical sectional view taken in the axial direction illustrating a constant rate discharge pump according to another embodiment of the present invention.
Figure 6:
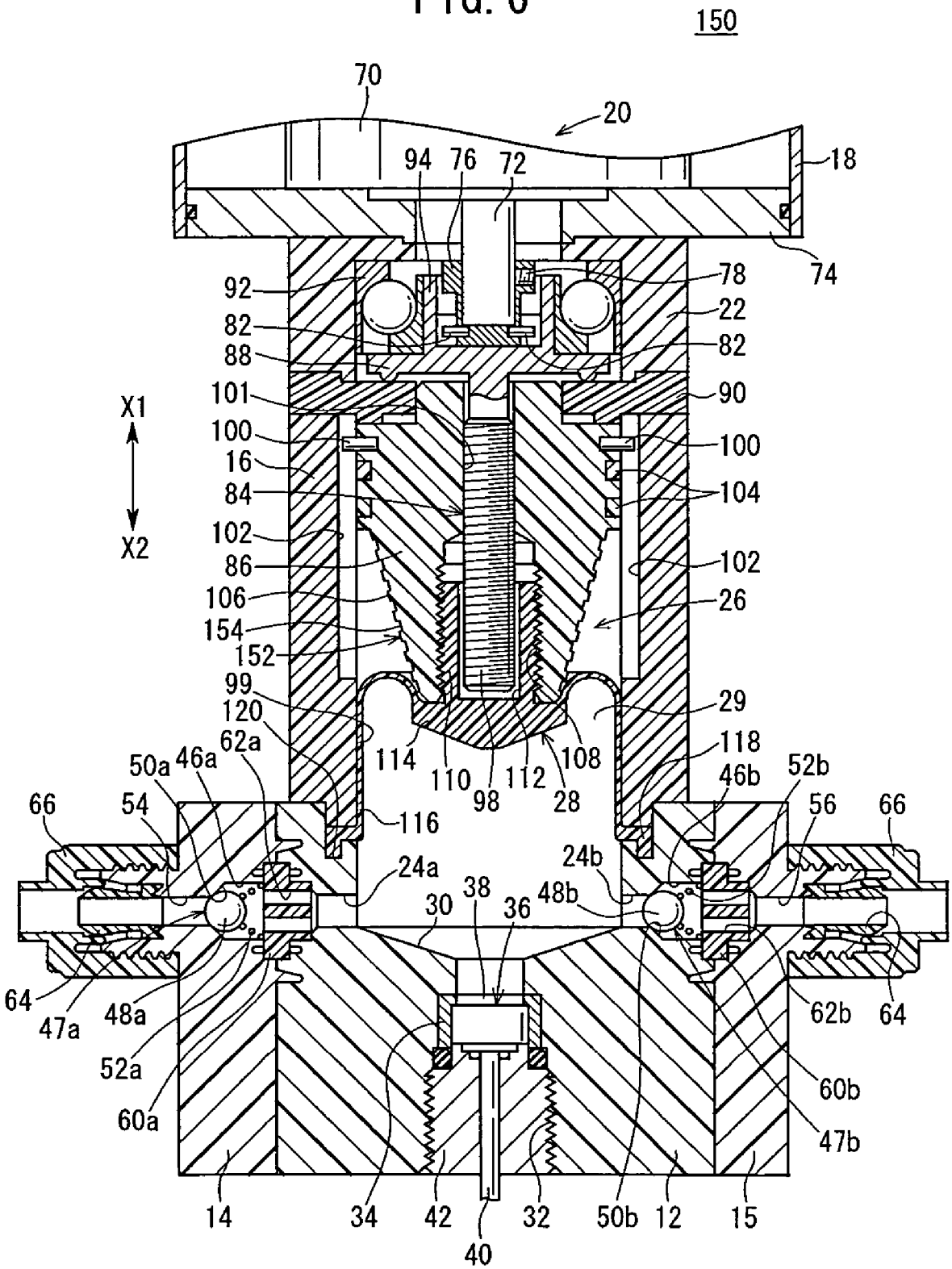
FIG. 6 is, with partial omission, a vertical sectional view taken in the axial direction illustrating a state in which a piston is displaced in the direction of the arrow X1 starting from a state shown in FIG. 5.

Next, a constant rate discharge pump 150 according to another embodiment is shown in FIGS. 5 and 6. The constituent elements that are same as those of the constant rate discharge pump 10 shown in FIGS. 1 and 2 are designated by the same reference numerals, and any detailed explanation thereof will be omitted.

The constant rate discharge pump 150 according to the another embodiment is different from the constant rate discharge pump 10 according to the embodiment described above in that a plurality of annular grooves 154, which are spaced from each other by predetermined distances, are formed in the circumferential direction on a tapered surface 106 of a piston 152. The annular groove 154 formed on the tapered surface 106 is not limited to any shape provided that the annular groove 154 is recessed by a predetermined depth with respect to the tapered surface 106.

An explanation will be made about a state (see FIG. 4) in which the piston 152 is displaced downwardly (in the direction of the arrow X2) by the rotary driving source 70, and the skirt section 116 is engaged with or disposed on the tapered surface 106 of the piston 152, for example, as shown in FIG. 5. In this state, the contact area between the tapered surface 106 and the upper surface of the skirt section 116 is decreased by the annular grooves 154 as compared with the case in which the annular grooves 154 are not provided.

Accordingly, the sticking force of the skirt section 116 with respect to the tapered surface 106 is decreased when the piston 152 is displaced downwardly (in the direction of the arrow X2). When the piston 152 is displaced upwardly (in the direction of the arrow X1), the skirt section 116 can be preferably and reliably separated from the tapered surface 106 of the piston 152. Therefore, it is possible to displace the piston 152 in the axial direction more smoothly.

While the invention has been particularly shown and described with reference to preferred embodiments, it will be understood that variations and modifications can be effected thereto by those skilled in the art without departing from the spirit and scope of the invention as defined by the appended claims.

What is claimed is:

1. A pump apparatus comprising:

a rotary driving source driven and rotated by an electric signal;

a body provided with a seat section and fluid passages for communicating with a first port for sucking a fluid and a second port for discharging said fluid;

a bonnet connected to said body and having a pump chamber defined therein;

a piston provided in said pump chamber displaceably in an axial direction of said body under a rotary driving action of said driving source, said piston having a tapered surface on an outer circumference with diameters gradually reduced toward said fluid passages; and a valve plug membrane connected to said piston and provided with a shaft section which is screw-fitted into said piston, a thick-walled main valve body section formed adjacent to said shaft section, and a flexible thin skirt section extending radially outwardly from a surface of said main valve body section and from said piston, wherein said valve plug membrane has a circumferential edge which is interposed between said body and said bonnet, and said valve plug membrane is displaceable in said axial direction while being retained in a state in which said valve plug membrane is bent convexly in one of displacement directions of said piston, and wherein said main valve body section of said valve plug membrane abuts against said seat section when said piston is displaced by operation of said rotary driving source.

2. The pump apparatus according to claim 1, wherein said skirt section is disposed on said tapered surface of said piston, and said skirt section rises along said tapered surface, when said piston is displaced in said axial direction.

3. The pump apparatus according to claim 1, wherein said skirt section is disposed on an inner wall surface of said bonnet, and said skirt section rises along said inner wall surface, when said piston is displaced in said axial direction.

4. The pump apparatus according to claim 1, wherein said piston has a substantially circular arc-shaped chamfered section which is formed at a position facing a seat section of said body for seating said valve plug membrane thereon.

5. The pump apparatus according to claim 1, further comprising:

a detecting section provided in said body for sensing a pressure of said fluid flowing through said fluid passages of said body.

6. The pump apparatus according to claim 1, wherein said body is provided therein with a first check valve provided on said first port and pressed in a direction toward said first port by a resilient force of a first spring, and a second check valve provided on said second port and pressed in a direction toward said pump chamber by a resilient force of a second spring.

7. The pump apparatus according to claim 6, wherein said first check valve is opened and said fluid is supplied into said pump chamber from said first port when said piston is displaced in a direction to separate from said seat section of said body, while said second check valve is opened and said fluid contained in said pump chamber flows from said second port to outside when said piston is displaced in a direction to approach said seat section.

8. The pump apparatus according to claim 1, wherein a rotary shaft, which is rotatable relative to said piston, is screwed with said piston in said axial direction, and an end of said rotary shaft is connected to a drive shaft of said driving source through a connecting member.

9. The pump apparatus according to claim 8, wherein the displacement of said shaft in said axial direction is restricted, and said rotary shaft is retained axially in said body and is rotatable through a bearing.

10. The pump apparatus according to claim 1, wherein an engaging groove recessed linearly in said axial direction is formed on an inner portion of said bonnet, and a rotation-preventive pin attached to said piston is engaged with said engaging groove.

11. The pump apparatus according to claim 10, wherein said engaging pin is displaced along said engaging groove when said piston is displaced in said axial direction in said bonnet.

12. The pump apparatus according to claim 1, wherein grooves, each of which is recessed by a predetermined depth, are formed on said tapered surface of said piston.

13. The pump apparatus according to claim 12, wherein said grooves are provided in a circumscribing manner along said tapered surface of said piston.

* * * * *